United States Patent [19]

Bravo

[11] Patent Number: 4,865,212

[45] Date of Patent: Sep. 12, 1989

[54] SEAL RIM INTEGRALLY FORMED WITH METAL CONTAINER

[75] Inventor: Rafael H. Bravo, Barcelona, Spain

[73] Assignee: Envases Masquefa, S.A., Barcelona, Spain

[21] Appl. No.: 164,569

[22] Filed: Mar. 7, 1988

[30] Foreign Application Priority Data

Mar. 6, 1987 [ES] Spain ..... 87 01016

[51] Int. Cl.[4] ..... B65D 8/02

[52] U.S. Cl. ..... 220/74; 220/1 BC; 220/67; 220/307; 220/352; 220/354

[58] Field of Search ..... 220/66, 67, 73, 74, 220/306, 307, 354, 355, 356, 1 BC, 352, 353, 68; 277/205, 236

[56] References Cited

U.S. PATENT DOCUMENTS

| | | | |
|---|---|---|---|
| 738,892 | 9/1903 | Echart | 220/355 |
| 926,461 | 6/1909 | Bertels | 220/352 |
| 1,031,238 | 7/1912 | Breckenridge | 220/352 |
| 1,603,330 | 10/1926 | Dister | 220/356 |
| 2,047,720 | 7/1936 | Wilhelm | 220/355 |
| 2,335,647 | 11/1943 | Chamberlain | 220/74 X |
| 2,905,357 | 9/1959 | Riener | 220/356 |
| 3,397,807 | 8/1968 | Taylor | 220/352 |
| 3,700,136 | 10/1972 | Ruekberg | 220/66 X |
| 4,421,247 | 12/1983 | Lombardo et al. | 220/359 |

FOREIGN PATENT DOCUMENTS

| | | | |
|---|---|---|---|
| 586697 | 4/1925 | France | 220/354 |
| 1063640 | 5/1954 | France | 220/355 |
| 516 | of 1879 | United Kingdom | 220/74 |
| 11101 | of 1897 | United Kingdom | 220/355 |
| 24353 | of 1907 | United Kingdom | 220/354 |
| 1394866 | 5/1975 | United Kingdom | 220/355 |

*Primary Examiner*—Bryon P. Gehman

*Attorney, Agent, or Firm*—Flynn, Thiel, Boutell & Tanis

[57] ABSTRACT

A rim structure for a metal container, such as a paint can, wherein the cylindrical sidewall of the container has adjacent its upper edge an outwardly diverging wall part which is folded over onto itself to form an outer top flange having a rounded cross section which extends radially inwardly. This top flange, at its radially inner edge, downwardly converges inside the outer wall part to define an inclined intermediate flange which projects axially downwardly to the vicinity where the exterior wall part diverges from the cylindrical sidewall. At this location, the intermediate flange is folded radially inwardly and upwardly to define a V-shaped fold which, on its radially inner side, defines an axially upwardly projecting inner flange for defining the container mouth. This inner annular flange has the inner surface thereof disposed substantially axially aligned with the inner surface of the cylindrical sidewall. This inner flange, at its upper end, is folded radially outwardly over onto itself to define an inner annular top flange which is radially spaced concentrically inwardly from the outer top flange, and is slightly axially lowered relative thereto.

7 Claims, 1 Drawing Sheet

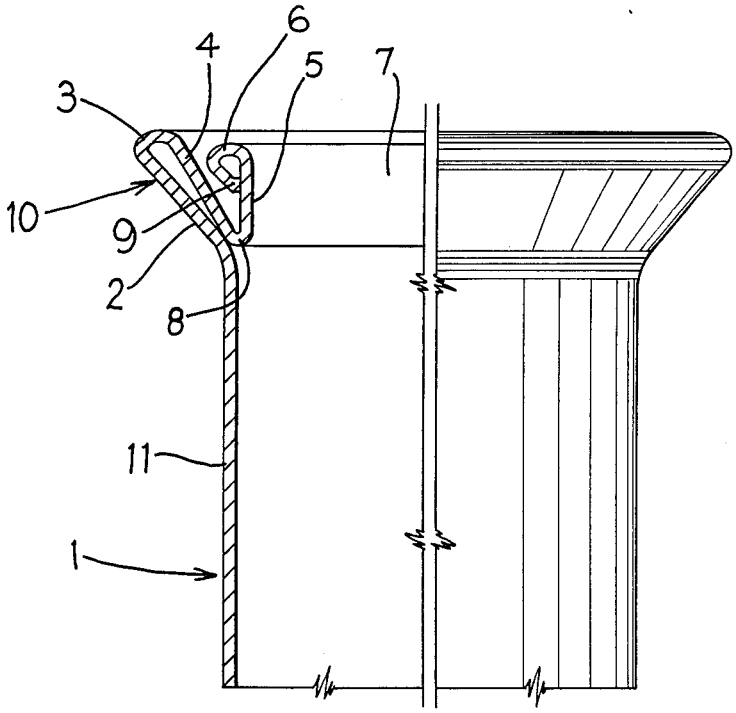
6
4
5
7
3
10
9
2
8
11
1

SEAL RIM INTEGRALLY FORMED WITH METAL CONTAINER

FIELD OF THE INVENTION

The present invention relates to an improved rim for defining the mouth or opening for a metal container.

BACKGROUND OF THE INVENTION

More specifically, an opening rim has been designed in the invention especially intended for metal containers having the shape of a cylinder of revolution intended to contain paints, enamels and other liquid products which require a hermetic seal for their preservation.

The present rim has special features which render it advantageous in practice with respect to the embodiments currently known on the market and which are intended for similar uses, by incorporating the precise conditions by means of which it is possible to reduce its cost since its manufacture is totally mechanical, achieved by means of one single operation of folding the rim of the opening of the container in order to obtain two concentric and substantially staggered flanges, all from one single sheet of metal, contrary to the traditional system which required a complex and expensive process to achieve an identical result.

In fact, the presently known technique requires first the making of the flange of the container in order to obtain a substantial widening of its opening; the manufacture of a metal ring with a particular section; and, finally, the joining of both elements by means of a mechanical process.

From the above, the considerable increase in cost represented by a traditional opening rim with respect to the opening rim which is the subject of the present registration is obvious, the latter being obtained by means of a single operation, the result of which is an opening rim of optimum type for receiving the lid which forms the hermetic seal.

BRIEF DESCRIPTION OF THE DRAWING

The single FIGURE is a fragmentary sectional view through the rim of a container according to the present invention.

DETAILED DESCRIPTION

The single FIGURE represents a fragmentary sectional view of a cylindrical container 1 having a cylindrical sidewall 11 and defining an opening or mouth 7 at one end thereof, which opening is surrounded by an annular rim 10 which is designed to receive the flange of a conventional lid or cover to create a hermetic seal.

The cylindrical sidewall 11 of the container 1, adjacent its upper end, has an annular wall part 2 which diverges or flares outwardly as it projects upwardly whereby this wall part 2 hence resembles a truncated conical configuration. This diverging wall part 2, at its upper end, is folded over radially inwardly into itself to form a rounded annular outer top flange 3 which has an outwardly rounded cross section and which then extends downwardly inside the exterior wall part 2 so as to define a further inclined annular flange 4 which is generally straight and which converges inwardly as it projects axially downwardly in approximately parallel relationship with the outer wall part 2.

The inclined flange 4 projects axially downwardly and radially inwardly so that the lower end of flange 4 is positioned substantially at a horizontal plane which defines the location where the exterior wall part 2 merges into the cylindrical sidewall 11. At this location, the lower end of the flange 4 is folded over radially inwardly onto itself to hence define a V-shaped annular fold 8 which is tightly rounded at the bottom and which opens upwardly.

The fold 8 joins to an annular vertical flange 5 which projects axially upwardly so as to be substantially straight and substantially parallel with the longitudinal (i.e. vertical) axis of the container. This flange 5 defines the mouth or opening 7. The inner surface of this flange 5 is substantially coaxially aligned with the inner surface of the cylindrical sidewall 11 so that the mouth or opening 7 has a diameter which approximately equals or is only slightly smaller than the inner diameter of the container 1. This axially extending flange 5, at its top or axially outer end, is folded over radially outwardly onto itself to form a rounded annular inner top flange 6 which has an outwardly rounded cross section. This fold or flange 6 is rounded in excess of 180° and terminates in a free edge 9 which is disposed so as to substantially contact the outer surface of the axial flange 5.

The annular inner top flange 6 is spaced concentrically inwardly from the outer top flange 3, with the flange 6 also being axially staggered relative to the flange 3. That is, flange 6 is, as illustrated by the drawing, displaced axially downwardly a small extent from the outermost extremity of the flange 3. This hence provides accommodation for the lid. Further, the fold or flange 6 preferably projects outwardly, due to its rounded configuration, so as to extend closely adjacent the surface of the intermediate inclined flange 4 so as to be substantially in tangential relationship thereto approximately midway between the outer top flange 3 and the V-shaped annular fold 8. With this arrangement, the conventional lid (not shown) is positioned to span the mouth 7 and effectively seat against the inner top flange 6, with the annular depending flange on the lid being inserted between the flanges 4 and 6 so as to create a hermetic seal.

As described above, and as shown in the drawing, the entire rim arrangement 10 is formed integrally from the thin sheetlike material defining the sidewall 11 so that the rim arrangement 10 and sidewall 11 are of an integral one-piece structure.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of this invention in which an exclusive property or privilege is claimed are defined as follows:

1. In a metal container having a cylindrical sidewall terminating at its upper end in an annular rim structure which surrounds and defines an opening into the container, the rim structure being adapted to sealingly engage a removable lid, the improvement comprising said rim structure in its entirety being formed integrally with said cylindrical sidewall and wherein: the cylindrical sidewall of the container in the vicinity of the upper end thereof has an integral outer wall part which diverges radially outwardly as it projects axially upwardly, said outer wall part at its upper edge being folded radially inwardly over onto itself to define an annular outer top flange having a rounded cross section, said outer top flange at its radially inner end having an intermediate inclined flange extending axially downwardly while converging radially inwardly therefrom, said intermediate inclined flange being generally straight as it inclines downwardly so as to terminate at a lower end disposed in the vicinity of where the outer wall part diverges from the cylindrical sidewall, said intermediate flange at its lower end being folded radially inwardly over onto itself to define a generally V-shaped fold which opens axially upwardly and defines an annular vertical flange which in turn defines said opening, said annular vertical flange projecting axially upwardly in straight and generally parallel relationship with the longitudinal axis of the container, said vertical flange defining thereon an inner annular surface having a diameter which is substantially equal to or only slightly smaller than the inner diameter of the cylindrical sidewall, said vertical flange at its upper end being folded radially outwardly over onto itself to define an annular inner top flange which is of rounded cross section and which is spaced concentrically within said outer top flange, said inner top flange being spaced axially downwardly a small extent from said outer top flange, and said inner top flange being folded through an angle in excess of 180° and terminating in a free edge part which substantially abuts an outer surface of said vertical flange, whereby said rim structure is integrally formed with said cylindrical sidewall from a single sheet of metal.

2. The rim structure according to claim 1, said inner top flange being substantially tangent to said intermediate inclined flange.

3. A rim for a hermetic seal metal container having a cylindrical sidewall, comprising:

an annular wall part integrally joined to and projecting upwardly from an upper edge of the cylindrical sidewall, said annular wall part being integrally folded over on itself at an upper edge thereof to form a rounded annular outer top flange, an inclined annular flange integrally joined to an extending radially inwardly and axially downwardly from said outer top flange, said inclined annular flange at a location remote from said outer top flange being integrally folded inwardly and upwardly onto itself to define a generally V-shaped fold formed by said inclined flange and an axially upstanding annular flange, said V-shaped fold opening axially upwardly, said upstanding flange having an integral free edge part remote from said fold, said free edge part being folded radially outwardly over against said upstanding flange to form a rounded annular inner top flange, and said inner top flange being substantially tangent to said inclined flange approximately midway between said fold and said outer top flange.

4. A rim according to claim 3, said wall part projecting radially outwardly and axially upwardly from said cylindrical sidewall.

5. A rim according to claim 3, said inclined annular flange being generally straight.

6. A rim according to claim 3, said upstanding annular flange being substantially coaxially aligned with the cylindrical sidewall and defining an opening into the meal container.

7. A rim according to claim 6, said opening having a diameter slightly smaller than an inner diameter of the cylindrical sidewall of the metal container.

* * * * *